US010109411B2

(12) United States Patent
Kudo et al.

(10) Patent No.: US 10,109,411 B2
(45) Date of Patent: Oct. 23, 2018

(54) COIL COMPONENT

(71) Applicant: Murata Manufacturing Co., Ltd., Kyoto (JP)

(72) Inventors: Hayami Kudo, Nagaokakyo (JP); Yoshimasa Yoshioka, Nagaokakyo (JP); Shinji Otani, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 15/393,376

(22) Filed: Dec. 29, 2016

(65) Prior Publication Data

US 2017/0200554 A1 Jul. 13, 2017

(30) Foreign Application Priority Data

Jan. 7, 2016 (JP) ..... 2016-001977

(51) Int. Cl.
*H01F 5/00* (2006.01)
*H01F 27/28* (2006.01)
(Continued)

(52) U.S. Cl.
CPC ..... *H01F 27/29* (2013.01); *H01F 5/003* (2013.01); *H01F 5/04* (2013.01); *H01F 27/255* (2013.01);
(Continued)

(58) Field of Classification Search
CPC . H01F 5/00; H01F 27/28; H01F 27/29; H01F 27/2804; H01F 27/255
(Continued)

(56) References Cited

U.S. PATENT DOCUMENTS 6,373,368 B1 * 4/2002 Shikama ..... H01F 41/04 29/605
6,727,792 B2 * 4/2004 Amada ..... H01F 17/045 336/192
(Continued)

FOREIGN PATENT DOCUMENTS

JP 2010-186909 A 8/2010
JP 2011-071457 A 4/2011
(Continued)

OTHER PUBLICATIONS

An Office Action; "Notification of Reasons for Refusal," Mailed by the Japanese Patent Office dated Aug. 21, 2018, which corresponds to Japanese Patent Application No. 2016-001977 and is related to U.S. Appl. No. 15/393,376; with English language translation.

*Primary Examiner* — Tsz Chan
(74) *Attorney, Agent, or Firm* — Studebaker & Brackett PC

(57) ABSTRACT

A coil component has a first surface and a second surface facing each other. The coil component has a coil conductor formed into a spiral shape, an insulating resin layer covering the coil conductor, a magnetic resin layer disposed on the first surface side of the insulating resin layer without being disposed on the second surface side of the insulating resin layer, and an external terminal disposed at least on one surface on the first surface side of the magnetic resin layer and electrically connected to the coil conductor. The magnetic resin layer is made of a composite material of a resin and a metal magnetic powder. The external terminal includes a metal film contacting the resin and the metal magnetic powder of the magnetic resin layer.

12 Claims, 11 Drawing Sheets

(51) Int. Cl.

| | |
|---|---|
| ***H01F 27/29*** | (2006.01) |
| ***H01F 27/255*** | (2006.01) |
| ***H01F 5/04*** | (2006.01) |
| ***H01F 27/36*** | (2006.01) |
| *G07D 7/164* | (2016.01) |

(52) U.S. Cl.
CPC ..... *H01F 27/2804* (2013.01); *H01F 27/365* (2013.01); *G07D 7/164* (2013.01)

(58) Field of Classification Search
USPC ..... 336/200, 232
See application file for complete search history.

(56) References Cited

U.S. PATENT DOCUMENTS

| | | | | |
|---|---|---|---|---|
| 2010/0157565 | A1* | 6/2010 | Yoshida | H01F 27/292 361/811 |
| 2014/0009254 | A1* | 1/2014 | Ohkubo | H01F 27/2804 336/192 |
| 2014/0176284 | A1* | 6/2014 | Lee | H01F 17/0013 336/200 |
| 2016/0035476 | A1* | 2/2016 | Mimura | H01F 17/0006 336/199 |

FOREIGN PATENT DOCUMENTS

| | | | |
|---|---|---|---|
| JP | 2013-140939 | A | 7/2013 |
| JP | 2014-013815 | A | 1/2014 |

* cited by examiner

COIL COMPONENT

CROSS REFERENCE TO RELATED APPLICATIONS

This application claims benefit of priority to Japanese Patent Application No. 2016-001977 filed Jan. 7, 2016, the entire content of which is incorporated herein by reference.

TECHNICAL FIELD

The present disclosure relates to a coil component.

BACKGROUND

Conventional coil components include a coil component described in Japanese Patent Publication No. 2014-13815. This coil component has a substrate, spiral coil conductors disposed on both surfaces of the substrate, an insulating resin layer covering the coil conductors, a magnetic resin layer covering the upper and lower sides of the insulating resin layer, an external terminal disposed on one surface of the magnetic resin layer via an insulating layer. On such a coil component, the external terminal is made up of a resin electrode film applied by screen printing of a resin paste containing a metal powder, for example.

SUMMARY

Problem to be Solved by the Disclosure

The present inventors are currently thinking about a coil component suppressing a magnetic flux leakage from a first surface of the coil component and preventing interference with generation of a magnetic field from a second surface on the side opposite to the first surface of the coil component. This coil component has a coil conductor, an insulating resin layer covering the coil conductor, and a magnetic resin layer disposed on the first surface side of the insulating resin layer without being disposed on the second surface side of the insulating resin layer.

However, it is found that the coil component may warp due to heat toward the first surface or the second surface when the coil component is actually fabricated. This is because of a difference in thermal expansion coefficient of the insulating resin layer and the magnetic resin layer generated between the first surface and the second surface of the coil component. In this case, when an external electrode made up of a resin electrode film is disposed on the first surface side of the magnetic resin layer of the coil component and the coil component is mounted on a substrate, the magnetic resin layer may warp due to heating at the time of mounting, heat generation during operation, a rise in ambient temperature, etc., and the external terminal bonded to the substrate may peel off from the magnetic resin layer.

Therefore, a problem to be solved by the present disclosure is to provide a coil component capable of ensuring the adhesion between the external terminal and the magnetic resin layer.

Solutions to the Problems

To solve the problem, a coil component of the present disclosure is a coil component having a first surface and a second surface facing each other, comprising:

a coil conductor formed into a spiral shape;

an insulating resin layer covering the coil conductor;

a magnetic resin layer disposed on the first surface side of the insulating resin layer without being disposed on the second surface side of the insulating resin layer; and an external terminal disposed at least on one surface on the first surface side of the magnetic resin layer and electrically connected to the coil conductor, the magnetic resin layer is made of a composite material of a resin and a metal magnetic powder, the external terminal includes a metal film contacting the resin and the metal magnetic powder of the magnetic resin layer.

The coil component of the present disclosure has the external terminal including a metal film contacting the resin and the metal magnetic powder of the magnetic resin layer and therefore can ensure the adhesion between the metal film and the magnetic resin layer as well as the adhesion between the external terminal and the magnetic resin layer. Thus, even when the warpage of the coil component occurs, the external terminal can hardly be peeled off from the magnetic resin layer. Additionally, since the film strength of the metal film can be ensured, the strength of the external terminal itself can be ensured so as to decrease the destruction of the external terminal due to the warpage of the coil component.

In an embodiment of the coil component, the coil component has an internal electrode that is embedded in the magnetic resin layer with an end surface exposed from the one surface of the magnetic resin layer and that is electrically connected to the coil conductor, the metal film of the external terminal is in contact with the end surface of the internal electrode, and the metal film has an area on the end surface side larger than the area of the end surface.

According to the embodiment, the metal film of the external terminal is in contact with the end surface of the internal electrode, and the metal film has an area on the end surface side larger than the area of the end surface. As a result, the area on the first surface side of the external terminal bonded to solder can be made larger relative to the width of the coil component and, when the external terminal is bonded by solder, the posture of the coil component becomes stable so that the mounting stability of the coil component can be improved. The mounting stability is improved without the need of increasing the area of the end surface of the internal electrode, and the magnetic resin layer can be restrained from being reduced in volume, so as to prevent degradation of characteristics. Additionally, since the internal electrode is not brought into contact with the solder at the time of mounting, the solder leaching of the internal electrode can be suppressed.

In an embodiment of the coil component, the external terminal has the metal film and a coating film covering the first surface side of the metal film.

According to the embodiment, since the external terminal has the metal film and a coating film covering the first surface side of the metal film, for example, by using a (low-resistance) material having a low electric resistance for the metal film and using a material with high solder leach resistance and solder wettability for the coating film, the external terminal is improved in design freedom in such a manner that the external terminal excellent in conductivity, reliability, and solder bondability can be constructed.

In an embodiment of the coil component, the metal film of each of a plurality of external terminals is disposed on the one surface of the magnetic resin layer, and a resin film is disposed on a portion without the metal film on the one surface of the magnetic resin layer.

According to the embodiment, since a resin film is disposed on a portion without the metal film on the one surface of the magnetic composite layer, the insulation between the multiple metal films (external terminals) can be improved. Additionally, the resin film is substituted for a mask at the time of pattern formation of the metal film, so that the manufacturing efficiency is improved. The resin film covers the metal magnetic powder exposed from the resin and therefore can prevent the metal magnetic powder from being exposed to the outside.

In an embodiment of the coil component, the external terminal is protruded further than the resin film to the side opposite to the one surface.

According to the embodiment, since the external terminal is protruded further than the resin film, the mounting stability of the external terminal can be improved.

In an embodiment of the coil component, the resin film contains a filler made of an insulating material.

According to the embodiment, since the resin film contains a filler made of an insulating material, the insulation between the external terminals can be improved.

In an embodiment of the coil component, the resin film does not contain a filler.

According to the embodiment, since the resin film does not contain a filler, a difference is made smaller between the thermal expansion coefficient of the magnetic resin layer and the thermal expansion coefficient of the resin film, and the warpage of the coil component toward the first surface or the second surface can be reduced so as to decrease the peeling of the external terminal from the magnetic resin layer and the destruction of the external terminal.

In an embodiment of the coil component, the thickness of the metal film is equal to or less than ⅕ of the thickness of the coil conductor.

According to the embodiment, since the thickness of the metal film is equal to or less than ⅕ of the thickness of the coil conductor and is sufficiently thinner than the coil conductor, the coil component can be reduced in height.

In an embodiment of the coil component, the thickness of the metal film is 1 μm or more and 10 μm or less.

According to the embodiment, since the thickness of the metal film is 1 μm or more and 10 μm or less, the coil component can be reduced in height.

In an embodiment of the coil component, the material of the metal film and the material of the internal electrode are the same kind of metal.

According to the embodiment, since the material of the metal film and the material of the internal electrode are the same kind of metal, the connection reliability can be improved.

In an embodiment of the coil component, the magnetic resin layer has a recess in a portion of the one surface, and the metal film is filled into the recess.

According to the embodiment, since the metal film is filled into the recess of the magnetic resin layer, the adhesion between the metal film and the magnetic resin layer can be improved.

In an embodiment of the coil component, the metal film goes around along an outer surface of the metal magnetic powder to the inner side of the magnetic resin layer.

According to the embodiment, since the metal film goes around along an outer surface of the metal magnetic powder to the inner side of the magnetic resin layer, the metal film is firmly bonded to the metal magnetic powder because of an increase in area of contact with the metal magnetic powder, and the anchor effect can be produced because of the contact with the magnetic composite body along the shape of the recess, so that the adhesion between the metal film and the magnetic composite body can be improved.

Effect of the Disclosure

According to the coil component of the present disclosure, since the external terminal includes the metal film contacting the resin and the metal magnetic powder of the magnetic resin layer, the adhesion between the external terminal and the magnetic resin layer can be improved.

DETAILED DESCRIPTION

The present disclosure will now be described in detail with shown embodiments.

First Embodiment

Figure 1:
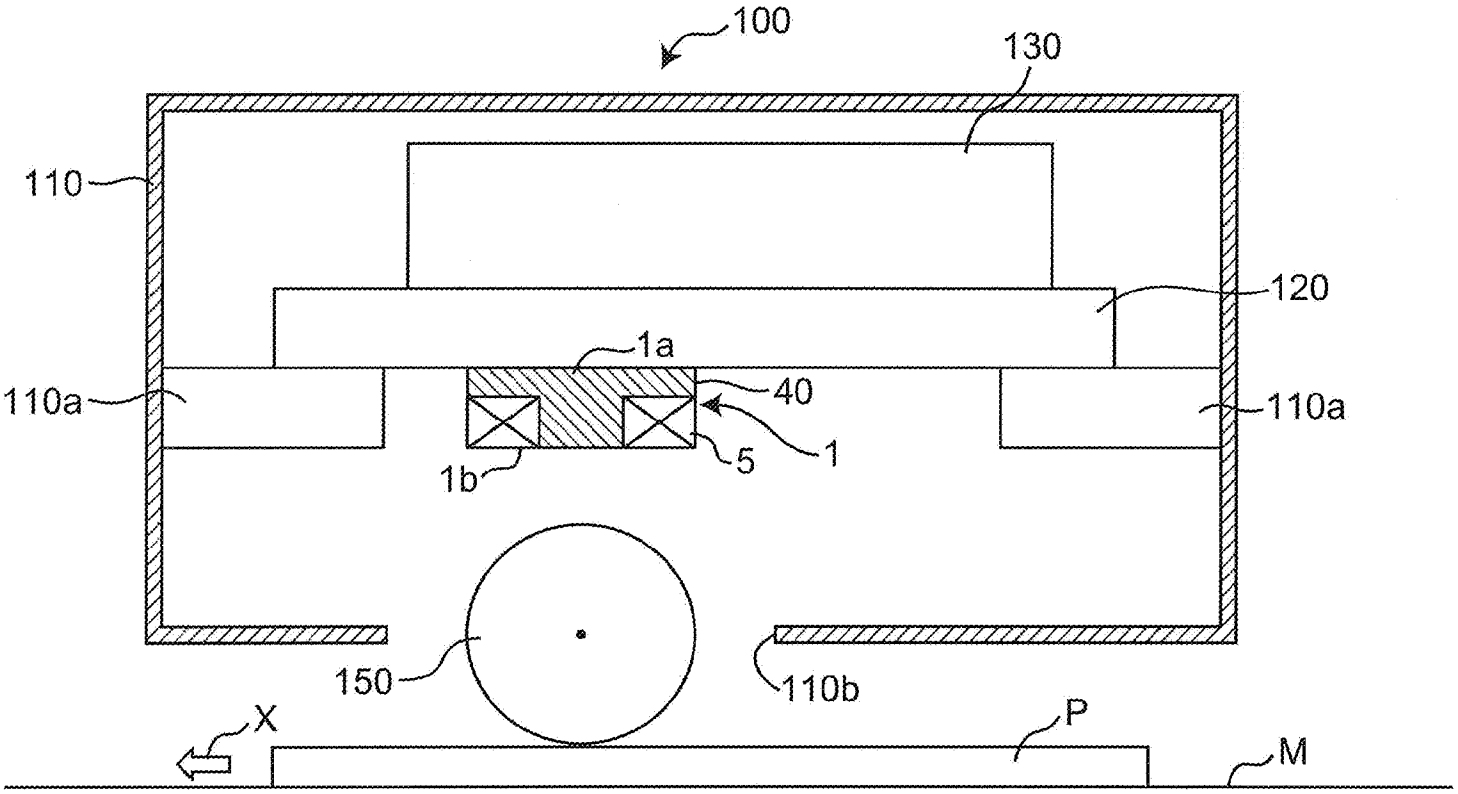
FIG. 1 is a simplified configuration diagram of a first embodiment of a thickness detection apparatus including a coil component of the present disclosure.

FIG. 1 is a simplified configuration diagram of a first embodiment of a thickness detection apparatus including a coil component of the present disclosure. As shown in FIG. 1, a thickness detection apparatus 100 is incorporated into an ATM (automatic teller machine), for example, and detects thickness of paper money. The thickness detection apparatus 100 is disposed above a conveyance path M to detect a thickness of a paper sheet P conveyed in an X direction of the conveyance path M.

The thickness detection apparatus 100 has a casing 110 as well as a mounting board 120, a coil component 1, and a thickness detection circuit 130 disposed in the casing 110, and a roller 150 disposed in an opening part 110*b* on the conveyance path M side of the casing 110.

The mounting board 120 is attached via an attaching part 110*a* to the inside of the casing 110. The coil component 1 is attached to a surface of the mounting board 120 on the conveyance path M side. The thickness detection circuit 130 is attached to a surface of the mounting board 120 on the side opposite to the conveyance path M. The roller 150 is attached to the casing 110 such that the roller 150 freely rotates and freely advances and retracts from the opening part 110*b*. The roller 150 is disposed to face the coil component 1 and freely moves close to and away from the coil component 1.

The roller 150 is rotated while being in contact with the paper sheet P and is displaced in a direction of the coil component 1 depending on the thickness of the paper sheet P. Therefore, the roller 150 detects the thickness of the paper sheet P as a displacement amount. A high frequency signal is applied to the coil component 1 to generate a high-frequency magnetic field. The roller 150 is made of a conductor and generates an eddy current due to the magnetic field generated from the coil component 1.

Figure 2:
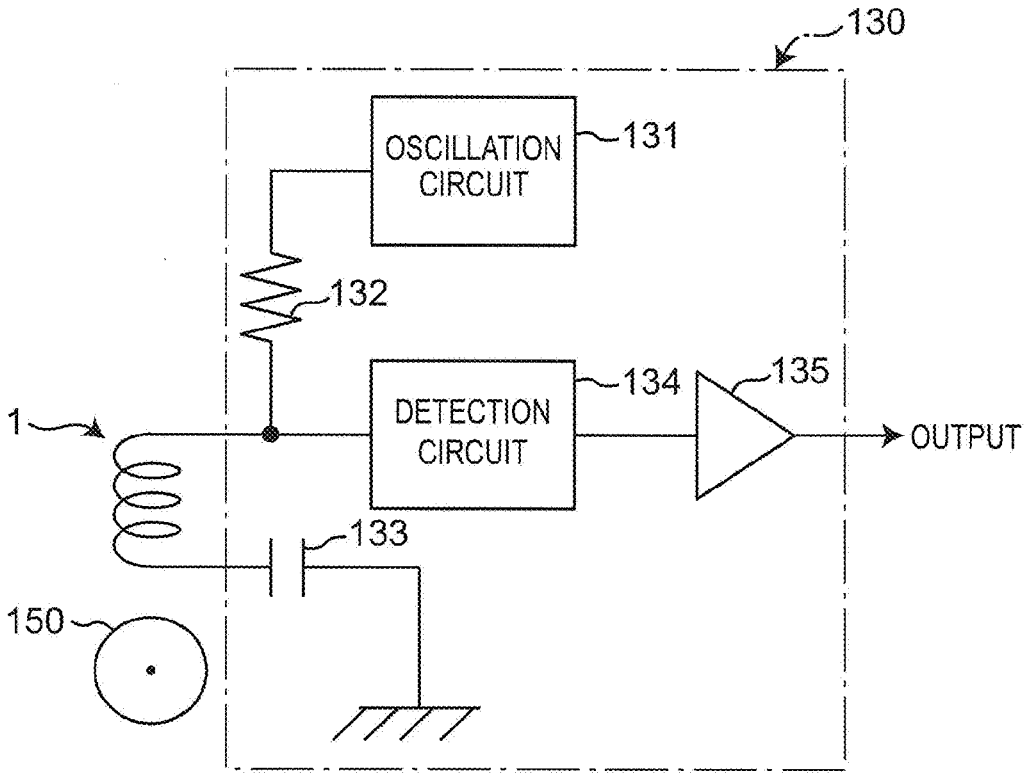
FIG. 2 is a circuit diagram of a thickness detection circuit.

As shown in FIG. 2, the thickness detection circuit 130 is a circuit electrically detecting the thickness of the paper sheet P and is made up of an oscillation circuit 131, a resistor 132, a capacitor 133, a detection circuit 134, and an amplification circuit 135. The oscillation circuit 131 outputs a high frequency signal through the resistor 132. One end of the coil component 1 (coil conductor) is connected through the resistor 132 to the oscillation circuit 131 and the other end of the coil component 1 (coil conductor) is grounded through the capacitor 133.

The detection circuit 134 is a circuit extracting a direct current signal corresponding to the amplitude of the high frequency signal from the oscillation circuit 131. This direct current signal is a signal proportional to a distance between the roller 150 described later and the coil component 1 (the thickness of the paper sheet P). The amplification circuit 135 amplifies a direct current signal input by the detection circuit 134. An output signal of the amplification circuit 135 corresponds to the thickness of the paper sheet P as a thickness detection result.

An operation of the thickness detection apparatus 100 will be described.

When the oscillation circuit 131 is driven, the oscillation circuit 131 supplies a high frequency signal through the resistor 132 to the coil component 1. As a result, a high-frequency current is applied to the coil component 1 and a high-frequency magnetic field is generated around the coil component 1.

When the paper sheet P is conveyed in the X direction in such a state, the roller 150 is rotated while being in contact with a surface of the paper sheet P, and is displaced in the direction of the coil component 1 depending on a thickness of the paper sheet P.

When the roller 150 is displaced in the direction toward the coil component 1, an eddy-current loss associated with the high-frequency magnetic field from the coil component 1 becomes larger and the amplitude of the high frequency signal from the oscillation circuit 131 therefore becomes smaller.

On the other hand, when the roller 150 is displaced in the direction away from the coil component 1, an eddy-current loss associated with the high-frequency magnetic field from the coil component 1 becomes smaller and the amplitude of the high frequency signal from the oscillation circuit 131 therefore becomes larger.

As described above, the distance between the roller 150 and the coil component 1 is proportional to the amplitude of the high frequency signal from the oscillation circuit 131. Therefore, since the distance between the roller 150 and the coil component 1 is proportional to the thickness of the paper sheet P, the amplitude of the high frequency signal from the oscillation circuit 131 is proportional to the thickness of the paper sheet P.

The high frequency signal from the oscillation circuit 131 is detected by the detection circuit 134. Thus, the detection circuit 134 outputs a direct current signal corresponding to the amplitude of the high frequency signal to the amplification circuit 135. As a result, the direct current signal is amplified by the amplification circuit 135. The output signal of the amplification circuit 135 is a signal corresponding to the thickness of the paper sheet P. In this way, the thickness detection apparatus 100 outputs the thickness of the paper sheet P as the signal from the amplification circuit 135.

Figure 3:
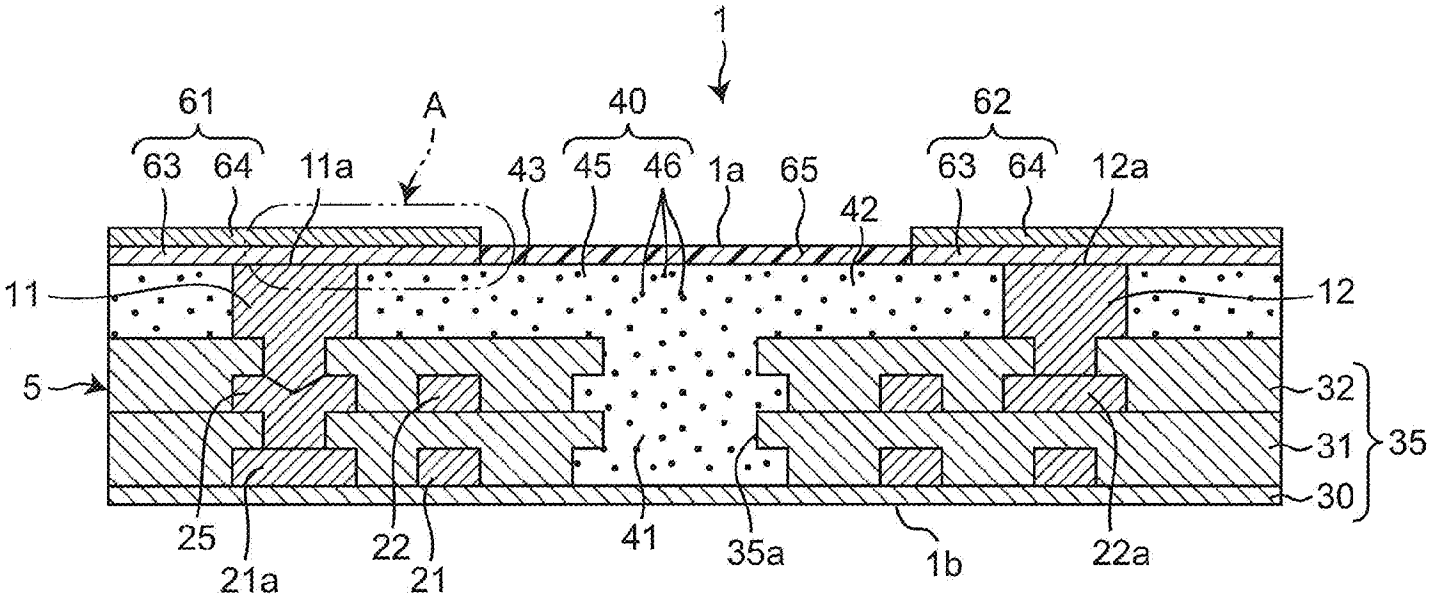
FIG. 3 is a cross-sectional view of a first embodiment of the coil component.

FIG. 3 is a cross-sectional view of a first embodiment of the coil component 1. As shown in FIGS. 1 and 3, the coil component 1 is a component generally having a rectangular parallelepiped shape, for example, and includes a first surface 1*a* and a second surface 1*b* facing each other. The first surface 1*a* is a mounting surface that is a side mounted on the mounting board 120. The second surface 1*b* is a detecting surface that is a side facing the roller 150 (an example of a detected conductor) and generates a magnetic field toward the roller 150. The first surface 1*a* is the surface on the mounting surface side of the coil component and is specifically made up of surfaces of first and second external terminals 61, 62 and a resin film 65 described later. The shape of the coil component 1 is not particularly limited as long as the shape includes the first surface 1*a* and the second surface 1*b* facing each other, and may be a circular columnar shape, a polygonal columnar shape, a truncated cone shape, or a truncated polygonal pyramid shape, for example.

The coil component 1 has a coil substrate 5 and a magnetic resin layer 40 partially covering the coil substrate 5. The coil substrate 5 has two layers of coil conductors 21, 22 (a first coil conductor 21 and a second coil conductor 22) and an insulating resin layer 35 covering the two layers of the coil conductors 21, 22.

The first and second coil conductors 21, 22 are arranged in order from a lower layer to an upper layer. The first and second coil conductors 21, 22 are made of low-resistance metal, for example, Cu, Ag, or Au. Preferably, low-resistance and narrow-pitch coil conductors can be formed by using Cu plating formed by a semi-additive process.

The first coil conductor 21 has a plane spiral shape clockwise from the outer circumference toward the inner circumference, for example. The second coil conductor 22 has a plane spiral shape clockwise from the inner circumference toward the outer circumference, for example. In FIG. 3, the numbers of turns of the coil conductors 21, 22 are reduced as compared to the actual numbers.

An outer circumferential part 21*a* of the first coil conductor 21 is connected to the first external terminal 61 through a lead wiring 25 disposed on the same layer as the second coil conductor 22 without connection to second coil conductor 22 and a first internal electrode 11 on a layer above the lead wiring 25. Similarly, an outer circumferential part 22*a* of the second coil conductor 22 is connected to the second external terminal 62 through a second internal electrode 12 on a layer above the outer circumferential part 22*a*.

An inner circumferential part of the first coil conductor 21 and an inner circumferential part of the second coil conductor 22 are electrically connected through a connection via (not shown) to each other. As a result, a signal input from the first external terminal 61 sequentially passes through the first coil conductor 21 and the second coil conductor 22 before being output from the second external terminal 62.

The central axes of the first and second coil conductors 21, 22 are concentrically arranged to intersect with the first surface 1*a* and the second surface 1*b*. In this embodiment, the central axes of the first and second coil conductors 21, 22 are orthogonal to the first surface 1*a* and the second surface 1*b*.

The insulating resin layer 35 has a base insulating resin 30 and first and second insulating resins 31, 32. The base insulating resin 30 and the first and second insulating resins 31, 32 are arranged in order from a lower layer to an upper layer. The material of the insulating resins 30 to 32 is, for example, a single material that is an organic insulating material made of an epoxy-based resin, bismaleimide, liquid crystal polymer, polyimide, etc., or is an insulating material comprising a combination of these organic insulating materials and an inorganic filler material such as a silica filler or an organic filler made of a rubber material. Preferably, all the insulating resins 30 to 32 are made of the same material. In this embodiment, all the insulating resins 30 to 32 are made of an epoxy resin containing a silica filler.

The first coil conductor 21 is laminated on the base insulating resin 30. The first insulating resin 31 is laminated on the first coil conductor 21 to cover the first coil conductor 21. The second coil conductor 22 is laminated on the first insulating resin 31. The second insulating resin 32 is laminated on the second coil conductor 22 to cover the second coil conductor 22.

The magnetic resin layer 40 is disposed on the first surface 1*a* side of the insulating resin layer 35 without being disposed on the second surface 1*b* side of the insulating resin layer 35. The magnetic resin layer 40 is also disposed in the inner diameter of the first and second coil conductors 21, 22 and in an inner diameter hole part 35*a* of the insulating resin layer 35. Therefore, the magnetic resin layer 40 has an inner portion 41 disposed in the inner diameter hole part 35*a* of the insulating resin layer 35 and an end portion 42 disposed on an end surface of the insulating resin layer 35 on the first surface 1*a* side. The inner portion 41 makes up an inner magnetic path of the coil component 1 and the end portion 42 makes up an outer magnetic path of the coil component 1. The end portion 42 of the magnetic resin layer 40 has a shape covering the end surface of the insulating resin layer 35 on the first surface 1*a* side and the inner portion 41 and, as a result, the magnetic resin layer 40 has one surface 43 as a principal surface on the first surface 1*a* side.

The magnetic resin layer 40 is made of a composite material of a resin 45 and a metal magnetic powder 46. The resin 45 is an organic insulating material made of an epoxy-based resin, bismaleimide, liquid crystal polymer, or polyimide, for example. The metal magnetic powder 46 is made of, for example, an FeSi alloy such as FeSiCr, an FeCo alloy, an Fe alloy such as NiFe, or an amorphous alloy thereof. The content percentage of the metal magnetic powder 46 is, preferably, 20 vol % or more and 70 vol % or less relative to the magnetic resin layer 40.

The first and second internal electrodes 11, 12 are embedded in the magnetic resin layer 40 and electrically connected to the first and second coil conductors 21, 22. End surfaces 11*a*, 12*a* of the first and second internal electrodes 11, 12 are exposed from the one surface 43 of the magnetic resin layer 40 on the first surface 1*a* side. It is assumed that this exposure includes not only the exposure to the outside of the coil component 1 but also the exposure to another member, i.e., the exposure at a boundary surface to another member. The first and second internal electrodes 11, 12 are made of the same material as the first and second coil conductors 21, 22, for example.

The first and second external terminals 61, 62 are disposed at least on the one surface 43 side of magnetic resin layer 40. The external terminals 61, 62 are electrically connected through the first and second internal electrodes 11, 12 to the coil conductors 21, 22.

The first and second external terminals 61, 62 each have a metal film 63 and a coating film 64 covering the metal film 63. The metal film 63 is in contact with the one surface 43 of the magnetic resin layer 40. The metal film 63 is made of, for example, low-resistance metal such as Cu, Ag, and Au. The material of the metal film 63 is, preferably, the same kind of metal as the material of the first and second internal electrodes 11, 12 and, in this case, the connection reliability can be improved between the metal film 63 and the first and second internal electrodes 11, 12. The metal film 63 is preferably formed by electroless plating. The metal film 63 may be formed by electrolytic plating, sputtering, or vapor deposition. The coating film 64 is made of, for example, a material with high solder leach resistance and solder wettability such as Sn, Ni, or Au or an alloy containing these elements, for example, and is formed by plating, sputtering, vapor deposition, etc. on the metal film 63. In this way, the first and second external terminals 61, 62 can have the metal film 63 made of a low-resistance material and the coating film 64 made of a material with high solder leach resistance and solder wettability. Therefore, the first and second external terminals 61, 62 are improved in design freedom in such a manner that the first and second external terminals 61, 62 excellent in conductivity, reliability, and solder bondability can be constructed. The coating film 64 may have a lamination structure and may have a configuration with a surface of a layer of Cu covered with a layer of Sn and a layer of Au, for example. Moreover, the coating film 64 is not an essential constituent element and the coating film 64 may not be included.

Figure 4:
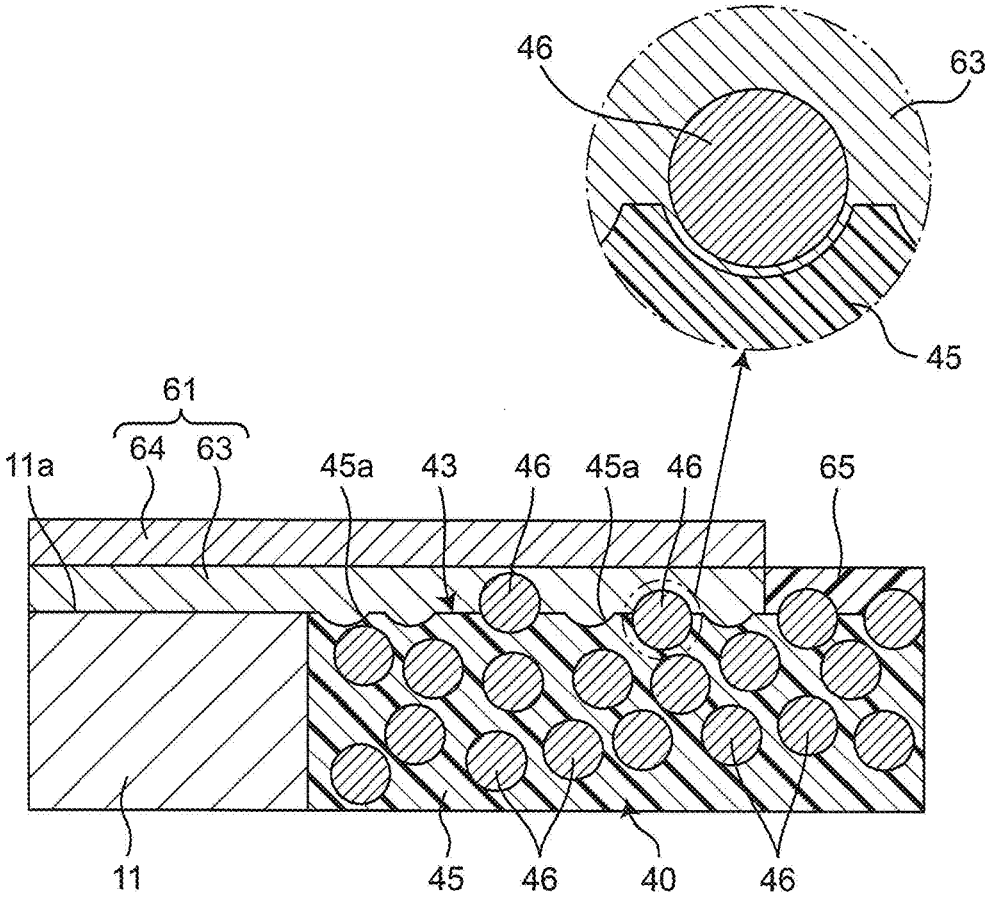
FIG. 4 is an enlarged view of a portion A of FIG. 3.

FIG. 4 is an enlarged view of a portion A of FIG. 3. As shown in FIGS. 3 and 4, the metal film 63 of the first external terminal 61 is in contact with the resin 45 and the metal magnetic powder 46 of the magnetic resin layer 40 as well as the end surface 11*a* of the first internal electrode 11. The metal film 63 of the first external terminal 61 has an area on the end surface 11*a* side larger than the area of the end surface 11*a*. The metal film 63 of the second external terminal 62 has the same configuration as the metal film 63 of the first external terminal 61. As a result, the areas of the first and second external terminals 61, 62 on the first surface 1*a* side, i.e., the area of the first and second external terminals 61, 62 on the mounting surface side can be made larger than the areas of the end surfaces 11*a*, 12*a*. Consequently, the areas of the first and second external terminals 61, 62 bonded to solder can be made larger relative to the width of the coil component 1 and, when the first and second external terminals 61, 62 are bonded by solder, the posture of the coil component 1 becomes stable so that the mounting stability of the coil component 1 can be improved. The mounting stability is improved in this way without the need of increasing the areas of the end surfaces 11*a*, 12*a* of the first and second internal electrodes 11, 12, and the magnetic resin layer 40 can be restrained from being reduced in volume due to an increase in the areas of the end surfaces 11*a*, 12*a*, so as to prevent degradation of characteristics (inductance value). The width of the coil component 1 in this case is the width of the mounting surface of the coil component 1 and refers to, for example, a length of a side of the principal surface (the first surface 1*a*) on the side disposed with the metal film 63. Specifically, for example, in FIG. 3, the width refers to a length of a side along a direction perpendicular to the plane of FIG. 3 on the principal surface of the coil component 1 located on the left side on the plane of FIG. 3.

Additionally, since the first and second internal electrodes 11, 12 are not brought into contact with the solder at the time of mounting, the solder leaching of the first and second internal electrodes 11, 12 can be suppressed.

The one surface 43 of the magnetic resin layer 40 is a ground surface formed by grinding. Therefore, on the one surface 43, the metal magnetic powder 46 is exposed from the resin 45. The magnetic resin layer 40 has recesses 45*a* in the resin 45 portion formed partially in the one surface 43 by shedding of particles of the metal magnetic powder 46 during grinding.

Particularly, the metal film 63 is filled into the recesses 45*a* of the resin 45. This produces the anchor effect so that the adhesion between the metal film 63 and the magnetic resin layer 40 can be improved. Additionally, as described later, the metal film 63 goes around along the outer surface of the metal magnetic powder 46 to the inner side of the magnetic resin layer 40. In particular, the metal film 63 penetrates along the outer surface of the metal magnetic powder 46 into a gap between the resin 45 and the metal magnetic powder 46. As a result, the metal film 63 is firmly bonded to the metal magnetic powder 46 because of an increase in area of contact with the metal magnetic powder 46, and the anchor effect can be produced because of the contact with the magnetic resin layer 40 along the recessed shape of the resin 45, so that the adhesion between the metal film 63 and the magnetic resin layer 40 can be improved. To fill the metal film 63 into the recesses 45*a*, for example, the metal film 63 may be formed by the electroless plating as described later. The recesses 45*a* may not entirely be filled with the metal film 63 and may partially be filled with the metal film 63.

The thickness of the metal film 63 is equal to or less than ⅕ of the thickness of each of the first and second coil conductors 21, 22. Specifically, the thickness of the metal film 63 is 1 μm or more and 10 μm or less. The thickness of the metal film 63 is preferably 5 μm or less. As a result, the coil component 1 can be reduced in height. Since the metal film 63 has a thickness of 1 μm or more, the metal film 63 can favorably be manufactured and, since the metal film 63 has a thickness of 10 μm or less, the coil component 1 can be reduced in height.

The resin film 65 is disposed on a portion without the metal film 63 on the one surface 43 of the magnetic resin layer 40. For example, the resin film 65 is made of a highly electrically insulating resin material such as an acrylic resin, an epoxy-based resin, and polyimide. As a result, the insulation between the first and second external terminals 61, 62 (the metal films 63) can be improved. Additionally, the resin film 65 is substituted for a mask at the time of pattern formation of the metal film 63, so that the manufacturing efficiency is improved. The resin film 65 covers the metal magnetic powder 46 exposed from the resin 45 and therefore can prevent the metal magnetic powder 46 from being exposed to the outside.

The first and second external terminals 61, 62 are protruded further than the resin film 65 to the side opposite to the one surface 43. In other words, the thickness of the first and second external terminals 61, 62 is larger than the film thickness of the resin film 65 and, as a result, when the first and second external terminals 61, 62 are solder-bonded, the mounting stability can be improved.

The resin film 65 may contain a filler made of an insulating material. As a result, the insulation between the first and second external terminals 61, 62 can be improved. Alternatively, the resin film 65 may not contain a filler. When the resin film 65 does not contain a filler, since a difference is made smaller between the thermal expansion coefficient of the resin film 65 and the thermal expansion coefficient of the magnetic resin layer 40, the warpage of the coil component 1 toward the first surface 1*a* or the second surface 1*b* due to the difference in the thermal expansion coefficient can be reduced so as to decrease the peeling of the external terminals 61, 62 from the magnetic resin layer 40 and the destruction of the external terminals 61, 62.

A method of manufacturing the coil component 1 will be described.

Figure 5A:
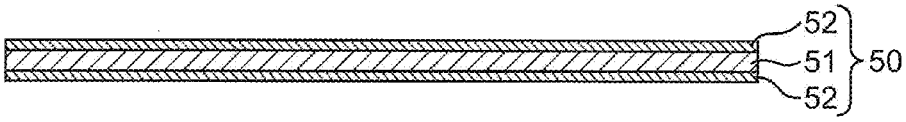
FIG. 5A is an explanatory view for explaining a first embodiment of a manufacturing method of the coil component of the present disclosure.

As shown in FIG. 5A, a base 50 is prepared. The base 50 has an insulating substrate 51 and base metal layers 52 disposed on both sides of the insulating substrate 51. In this embodiment, the insulating substrate 51 is a glass epoxy substrate and the base metal layers 52 are Cu foils. Since the thickness of the base 50 does not affect the thickness of the coil component 1 because the base 50 is peeled off as described later, the base with easy-to-handle thickness may be used as needed for the reason of warpage due to processing etc.

Figure 5B:
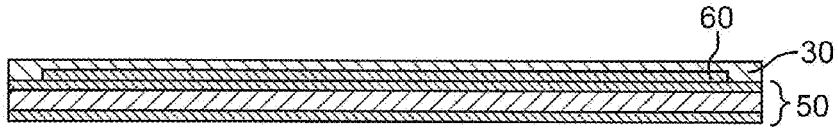
FIG. 5B is an explanatory view for explaining the first embodiment of the manufacturing method of the coil component of the present disclosure.

As shown in FIG. 5B, a dummy metal layer 60 is bonded onto a surface of the base 50. In this embodiment, the dummy metal layer 60 is a Cu foil. Since the dummy metal layer 60 is bonded to the base metal layer 52 of the base 50, the dummy metal layer 60 is bonded to a smooth surface of the base metal layer 52. Therefore, an adhesion force can be made weak between the dummy metal layer 60 and the base metal layer 52 and, at a subsequent step, the base 50 can easily be peeled from the dummy metal layer 60. Preferably, an adhesive bonding the base 50 and the dummy metal layer 60 is an adhesive with low tackiness. For weakening of the adhesion force between the base 50 and the dummy metal layer 60, it is desirable that the bonding surfaces of the base 50 and the dummy metal layer 60 are glossy surfaces.

Subsequently, the base insulating resin 30 is laminated on the dummy metal layer 60 temporarily bonded to the base 50. In this case, the base insulating resin 30 is laminated by a vacuum laminator and is then thermally cured.

Figure 5C:
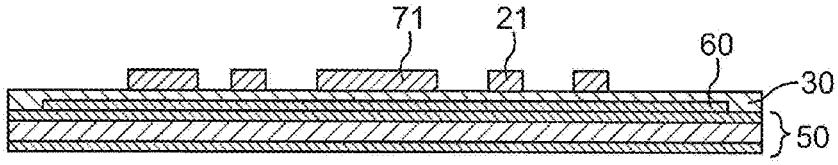
FIG. 5C is an explanatory view for explaining the first embodiment of the manufacturing method of the coil component of the present disclosure.

As shown in FIG. 5C, the first coil conductor 21 and a first sacrificial conductor 71 corresponding to the inner magnetic path are disposed on the base insulating resin 30. In this case, the first coil conductor 21 and the first sacrificial conductor 71 are formed at the same time by the semi-additive process.

Figure 5D:
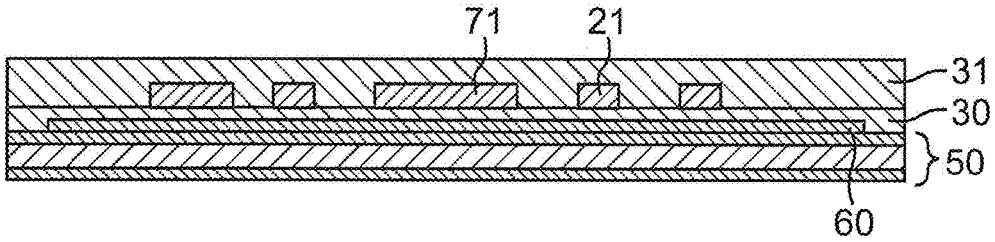
FIG. 5D is an explanatory view for explaining the first embodiment of the manufacturing method of the coil component of the present disclosure.

As shown in FIG. 5D, the first coil conductor 21 and the first sacrificial conductor 71 are covered with the first insulating resin 31. In this case, the first insulating resin 31 is laminated by a vacuum laminator and is then thermally cured.

Figure 5E:
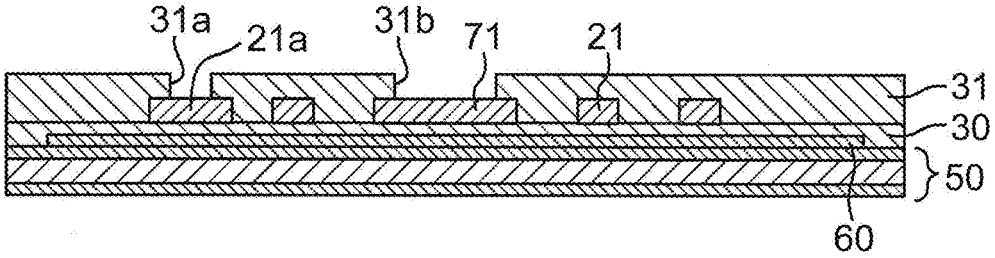
FIG. 5E is an explanatory view for explaining the first embodiment of the manufacturing method of the coil component of the present disclosure.

As shown in FIG. 5E, the via hole 31*a* is disposed in a portion of the first insulating resin 31 to expose the outer circumferential part 21*a* of the first coil conductor 21, and an opening part 31*b* is disposed in a portion of the first insulating resin 31 to expose the first sacrificial conductor 71. The via hole 31*a* and the opening part 31*b* are formed by laser machining.

Figure 5F:
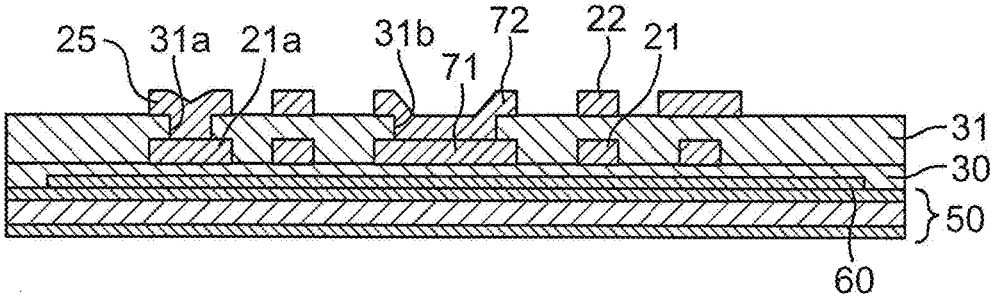
FIG. 5F is an explanatory view for explaining the first embodiment of the manufacturing method of the coil component of the present disclosure.

As shown in FIG. 5F, the second coil conductor 22 is disposed on the first insulating resin 31. The lead wiring 25 is disposed in the via hole 31*a* of the first insulating resin 31 and is connected to the outer circumferential part 21*a* of the first coil conductor 21. A second sacrificial conductor 72 corresponding to the inner magnetic path is disposed on the first sacrificial conductor 71 in the opening part 31*b* of the first insulating resin 31.

Figure 5G:
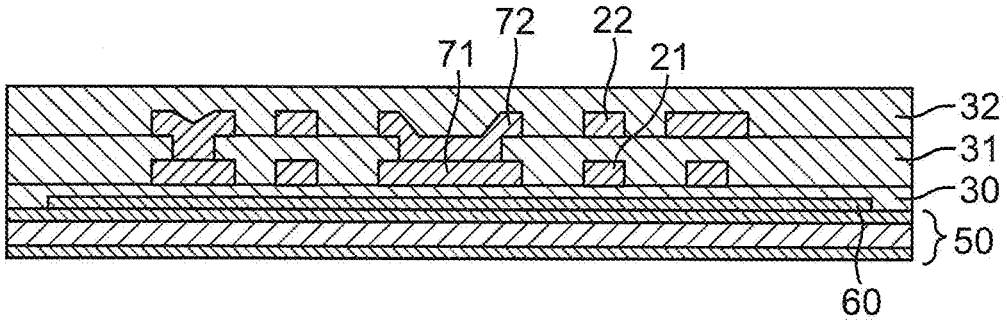
FIG. 5G is an explanatory view for explaining the first embodiment of the manufacturing method of the coil component of the present disclosure.

As shown in FIG. 5G, the second coil conductor 22 and the second sacrificial conductor 72 are covered with the second insulating resin 32.

Figure 5H:
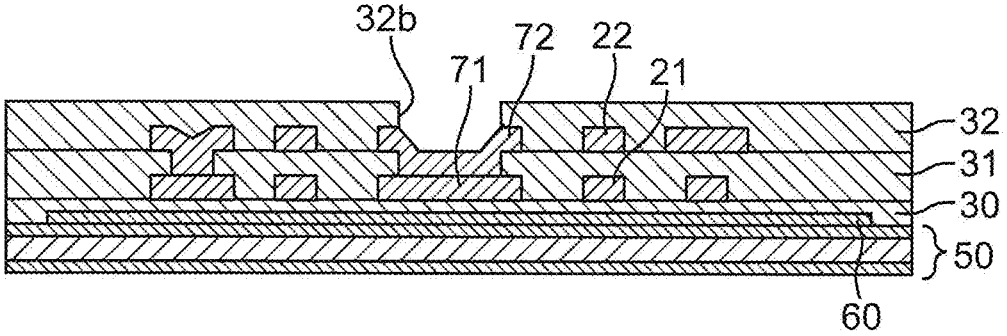
FIG. 5H is an explanatory view for explaining the first embodiment of the manufacturing method of the coil component of the present disclosure.

As shown in FIG. 5H, an opening part 32*b* is disposed in a portion of the second insulating resin 32 to expose the second sacrificial conductor 72.

Figure 5I:
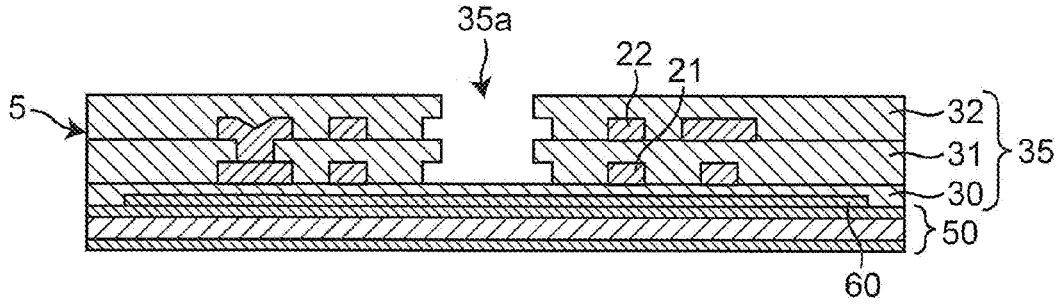
FIG. 5I is an explanatory view for explaining the first embodiment of the manufacturing method of the coil component of the present disclosure.

As shown in FIG. 5I, the first and second sacrificial conductors 71, 72 are removed and the inner diameter hole part 35*a* corresponding to the inner magnetic path is disposed in the first and second insulating resins 31, 32. The first and second sacrificial conductors 71, 72 are removed by etching. The materials of the sacrificial conductors 71, 72 are, for example, the same material as the coil conductors 21, 22. In this way, the coil substrate 5 is formed of the coil conductors 21, 22 and the insulating resins 30 to 32.

Figure 5J:
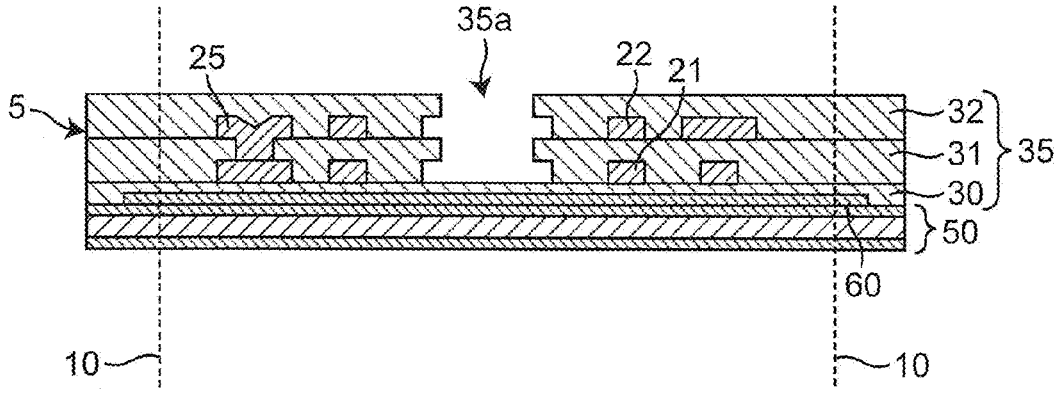
FIG. 5J is an explanatory view for explaining the first embodiment of the manufacturing method of the coil component of the present disclosure.

As shown in FIG. 5J, an end part of the coil substrate 5 is cut off along a cutline 10 together with an end part of the base 50. The cutline 10 is located on the inner side of an end surface of the dummy metal layer 60.

Figure 5K:
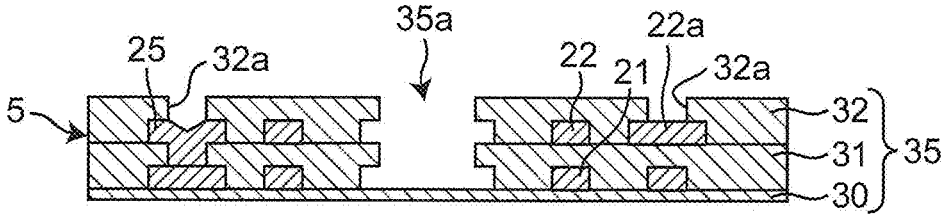
FIG. 5K is an explanatory view for explaining the first embodiment of the manufacturing method of the coil component of the present disclosure.

As shown in FIG. 5K, the base 50 is peeled off from the dummy metal layer 60 on the bonding plane between the surface of the base 50 (the base metal layer 52) and the dummy metal layer 60 and the dummy metal layer 60 is removed by etching. Subsequently, a via hole 32*a* is disposed in a portion of the second insulating resin 32 to expose the outer circumferential part 22*a* of the second coil conductor 22.

Figure 5L:
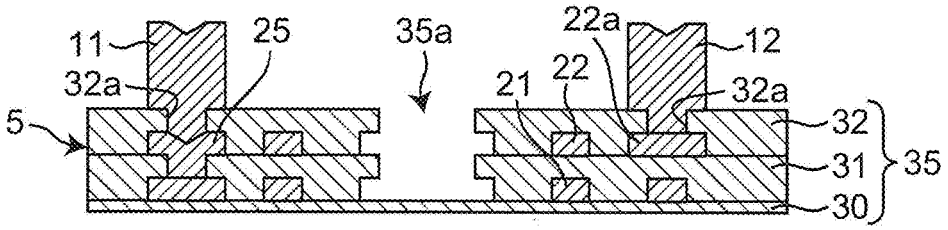
FIG. 5L is an explanatory view for explaining the first embodiment of the manufacturing method of the coil component of the present disclosure.

As shown in FIG. 5L, the first and second internal electrodes 11, 12 are disposed in the via hole 32*a* of the second insulating resin 32 to connect the first internal electrode 11 to the lead wiring 25 and connect the second internal electrode 12 to the outer circumferential part 22*a* of the second coil conductor 22. The first and second internal electrodes 11, 12 are formed by the semi-additive process.

Figure 5M:
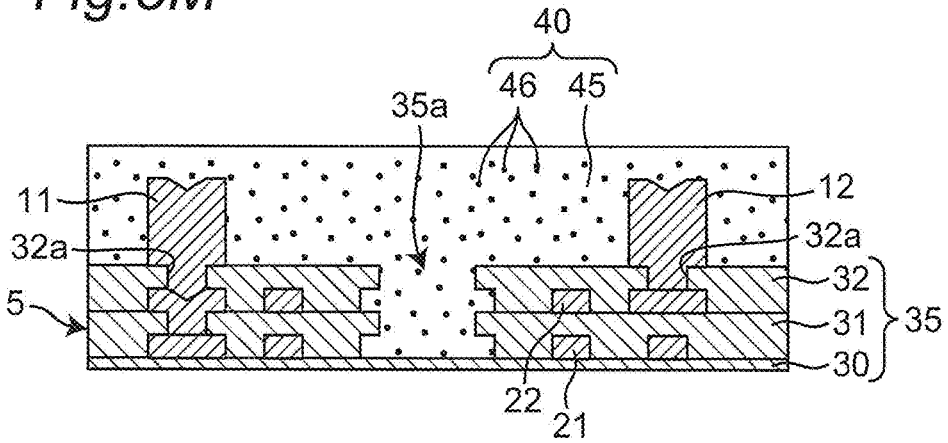
FIG. 5M is an explanatory view for explaining the first embodiment of the manufacturing method of the coil component of the present disclosure.

As shown in FIG. 5M, one surface of the coil substrate on the second insulating resin 32 side is covered with the magnetic resin layer 40. In this case, a plurality of sheets of the shaped magnetic resin layer 40 is disposed on one side of the coil substrate 5 in the lamination direction, is heated and press-bonded by a vacuum laminator or a vacuum press machine, and is subsequently subjected to cure treatment. The magnetic resin layer 40 is filled into the inner diameter hole part 35*a* of the insulating resin layer 35 to make up the inner magnetic path and is disposed on one surface of the insulating resin layer 35 to make up the outer magnetic path.

Figure 5N:
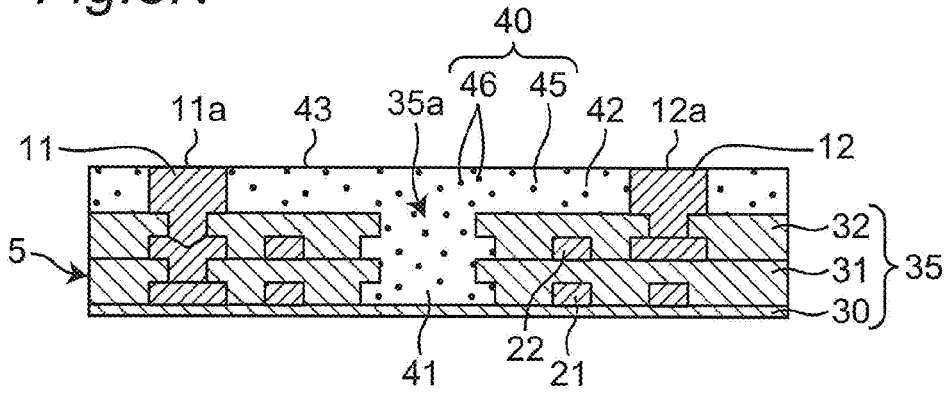
FIG. 5N is an explanatory view for explaining the first embodiment of the manufacturing method of the coil component of the present disclosure.

As shown in FIG. 5N, the magnetic resin layer 40 is subjected to grinding by a back grinder etc. to adjust chip thickness. In this case, the end surfaces 11*a*, 12*a* of the first and second internal electrodes 11, 12 are exposed from the one surface 43 of the magnetic resin layer 40. By grinding the magnetic resin layer 40, the metal magnetic powder 46 is exposed from the ground surface (the one surface 43) of the magnetic resin layer 40. In this case, the recesses 45*a* may be formed by shedding of particles of the metal magnetic powder 46 in a portion (the resin 45 portion) of the ground surface of the magnetic resin layer 40.

Figure 5O:
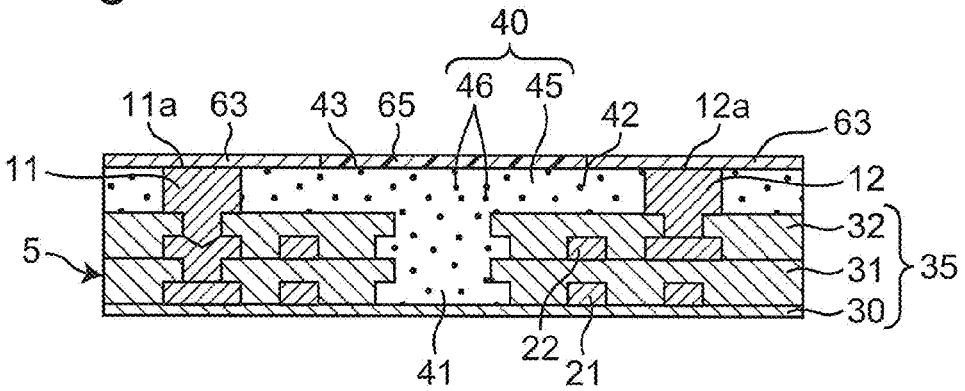
FIG. 5O is an explanatory view for explaining the first embodiment of the manufacturing method of the coil component of the present disclosure.

As shown in FIG. 5O, the resin film 65 is formed by screen printing on the one surface 43 of the magnetic resin layer 40. In this case, the resin film 65 is disposed with opening parts at positions corresponding to the external terminals 61, 62. The opening parts may be formed by photolithography etc. The opening parts are arranged such that the end surfaces 11*a*, 12*a* of the first and second internal electrodes 11, 12 are exposed. The metal films 63 are formed in the opening parts of the resin film 65 by the electroless plating. The metal films 63 may be formed by sputtering, vapor deposition, electrolytic plating, etc.

Figure 5P:
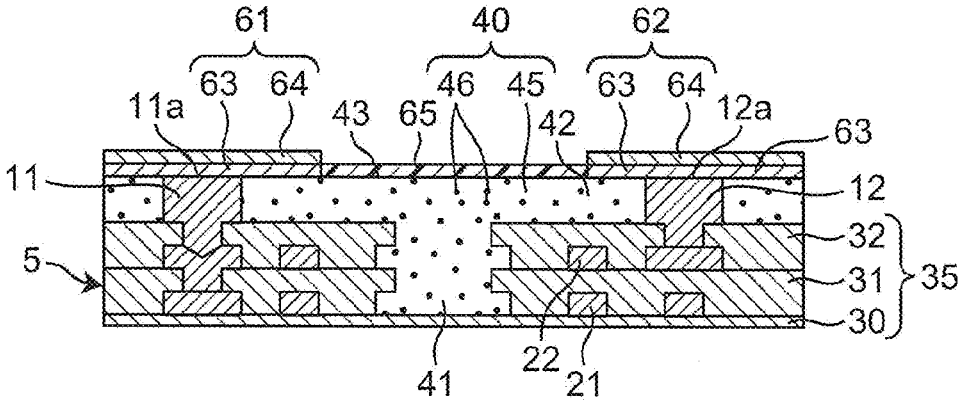
FIG. 5P is an explanatory view for explaining the first embodiment of the manufacturing method of the coil component of the present disclosure.

Subsequently, as shown in FIG. 5P, the coating films 64 are formed to cover the metal films 63 so as to form the external terminals 61, 62. The coating films 64 are, for example, plating of Ni, Au, Sn, etc. formed by a method such as electrolytic plating. Lastly, the coil substrate 5 is diced or scribed into individual pieces to form the coil component 1.

The above description is an example of the manufacturing method of the coil component 1 and is not a limitation and, for example, the cutting off of FIG. 5J and the individualization at the end may be performed together. The coating films 64 may be formed by barrel-plating, sputtering, vapor deposition, etc.

The adhesion between the external terminals 61, 62 and the magnetic resin layer 40 in the coil component 1 will be described. For the external terminals 61, 62 etc. of the coil component 1, a resin electrode film is often used that is applied by screen printing of a resin paste typically containing a metal powder of a conductor such as Cu. Therefore, the external terminals typically include resin electrode films in contact with the magnetic resin layer. In this case, to ensure the adhesion between the resin electrode film and the magnetic resin layer as well as the film strength and the conductivity of the resin electrode film itself, the film thickness of the resin electrode film must be made larger to some extent. However, electronic components such as the coil component 1 often have a limitation imposed on the thickness of the external terminals from the viewpoint of reducing height etc. Particularly, it was found that since the actually fabricated coil component 1 has the magnetic resin layer 40 disposed only on the first surface 1*a* side, a difference in thermal expansion coefficient is generated between the insulating resin layer 35 (the second surface 1*b*) and the magnetic resin layer 40 (the first surface 1*a*) and may lead to warpage of the coil component 1 due to heat toward the first surface 1*a* or the second surface 1*b*. Because of such a limitation on the film thickness and the warpage of the coil component, when the external terminals 61, 62 include the resin electrode films in the configuration of the coil component 1, the adhesion, the film strength, and the conductivity may not sufficiently be ensured. In contrast, according to the coil component 1, the external terminals 61, 62 include the metal films 63 in contact with the resin 45 and the metal magnetic powder 46 of the magnetic resin layer 40. As compared to the resin electrode films, the metal films 63 have lower rates of decrease in the adhesion with the magnetic resin layer 40 as well as the film strength and the conductivity of the metal films 63 themselves even when the film thickness is reduced. Therefore, the coil component can ensure the adhesion between the metal films 63 and the magnetic resin layer 40 as well as the adhesion between the external terminals 61, 62 and the magnetic resin layer 40. Thus, even when the warpage of the coil component 1 occurs, the external terminals 61, 62 can hardly be peeled off from the magnetic resin layer 40. Additionally, since the coil component 1 can ensure the film strength of the metal films 63, the strength of the external terminals 61, 62 themselves can be ensured so as to decrease the destruction of the external terminals due to the warpage of the coil component 1. Additionally, the coil component 1 can ensure the conductivity of the metal film 63 and therefore can ensure the conductivity of the external terminals 61, 62.

In a conventional example described in Japanese Patent Publication No. 2014-13815, since metal magnetic powder containing resins (magnetic resin layers) are disposed on both surface sides of a coil component, the coil component does not warp in the first place. Therefore, even when an external terminal includes a resin electrode film in contact with a magnetic resin layer, the external terminal is unlikely to cause a problem of peeling off from the magnetic resin layer. Particularly, considering the fact that the resin electrode films are conventionally extremely frequently used for external terminals of electronic components, it is hard to conceive of purposefully using the configuration of the external terminals 61, 62 including the metal films 63 as in the coil component 1 for the configuration of the conventional example. Therefore, it cannot possibly be assumed that the metal films of the present disclosure are used for the external terminals based on the conventional example.

(More Preferable Forms)

More preferably forms will be described.

The coil component 1 preferably has the metal films 63 formed by plating. Particularly, the metal films 63 are preferably formed by electroless plating and, in this case, the average particle diameter of crystals of the metal films 63 contacting the resin 45 is 60% or more and 120% or less of the average particle diameter of crystals of the metal films 63 contacting the metal magnetic powder 46. A state of the metal films 63 having a small difference in average particle diameter of crystals between on the metal magnetic powder 46 and on the resin 45 as described above corresponds to a state in which the metal films 63 with a comparatively small crystal particle diameter have been able to be formed on the resin 45.

Specifically, in general, a metal film formed on the magnetic resin layer by plating starts precipitating on the metal magnetic powder and gradually precipitates around the metal magnetic powder including on the resin. As described later, the average particle diameter of crystals of the metal film formed by plating becomes larger in a region of later precipitation than a region of earlier precipitation. Therefore, as in the metal films 63 in the preferable form described above, when a difference in average particle diameter of crystals is small between the metal films 63 contacting the metal magnetic powder 46, i.e., the metal films 63 precipitating earlier, and the metal films 63 contacting the resin 45, i.e., the metal films 63 precipitating later, this state corresponds to a state in which the metal films 63 have been able to be formed on the resin 45 in a comparatively early stage so that the metal films 63 with a comparatively small particle diameter have been able to be formed on the resin 45.

The adhesion between the metal films 63 and the resin 45 different in material is significantly affected by the anchor effect due to contact between the metal films 63 and the resin 45 along unevenness. Since the metal films 63 in the preferable form described above have a small particle diameter of crystals, even when the resin 45 has slight unevenness, an interface can be formed along the unevenness. Therefore, the metal films 63 easily produce the anchor effect between the metal films 63 and the resin 45 so that the adhesion between the resin 45 and the metal films 63 can be improved. Thus, the adhesion on the resin 45 can be ensured to improve the adhesion of the entire metal films 63 to the magnetic resin layer 40.

It is considered that when the metal films 63 are formed by using the electroless plating, a difference in average particle diameter of the metal films 63 can be made smaller between on the metal magnetic powder 46 and on the resin 45 as described above because of the following reason. Although barrel plating is generally employed for the coil component 1 etc. from the viewpoint of manufacturing efficiency when electrolytic plating is performed, this leads to large variations in precipitation timing in portions of the formed metal films 63 including a portion on the resin 45 because timing of energization varies for each particle of the metal magnetic powder 46. In contrast, in the electroless plating, the metal films 63 start precipitating on the metal magnetic powder coming into contact with a plating solution and, since the particles of the metal magnetic powder 46 come into contact with the plating solution at relatively uniform timings, the precipitation timings can be made relatively uniform over the portions of the formed metal films 63. Since the electroless plating makes the precipitation timings closer to each other among the portions of the metal films 63 in this way, the difference in average particle diameter of crystals of the metal films 63 can be made smaller between on the metal magnetic powder 46 and on the resin 45 as described above.

In the case of a film formed by sputtering or vapor deposition, since it is considered that a difference in average particle diameter of crystals is not generated due to formation timing as in the plating, the same effect is difficult to produce. As compared to sputtering or vapor deposition, the metal films 63 formed by using plating have high adhesion to the metal magnetic powder 46 and, therefore, the plating is preferably used from the viewpoint of the adhesion of the entire metal films 63 to the magnetic resin layer 40. Also from the viewpoints of equipment, processes, a formation time, high manufacturing efficiency such as the number of treatments, and low electric resistivity of the metal films 63, the plating is preferably used as compared to sputtering or vapor deposition.

A ratio of average particle diameters in this application is obtained by calculating an average particle diameter of crystals (particle aggregates) constituting the metal films 63 from an FIB-SIM image of a cross section of the metal films 63. The FIB-SIM image is a cross-sectional image observed by using an FIB (Focused Ion Beam) with an SIM (Scanning Ion Microscope). A method of calculating an average particle diameter may be a method including obtaining a particle size distribution from image analysis of the FIB- SIM image and determining a particle diameter at the integrated value of 50% (D50, median diameter) as the average particle diameter. However, since a ratio (relative value) rather than an absolute value of the average particle diameter is important, when the image analysis is difficult, a method may be used that includes measuring a plurality of maximum diameters of crystals of the metal films 63 as particle diameters in the FIB-SIM image and obtaining an arithmetic mean value thereof as the average particle diameter.

In the calculation, the number of crystals to be measured in terms of particle diameter may be about 20 to 50. The "crystals of the metal films 63 contacting the resin 45" and the "crystals of the metal films 63 contacting the metal magnetic powder 46" covered by the calculation are not strictly limited to the crystals directly contacting the resin 45 or the metal magnetic powder 46 and include crystals present within a range of about 1 μm from the interface between the metal films 63 and the resin material 45 or the interface between the metal films 63 and the metal magnetic powder 46 in the film thickness direction of the metal films 63. Although a relation of the ratio of the average particle diameter is preferably established in the entire metal films 63, the effect is produced even when the relation is established in a portion of the metal films 63. Therefore, the average particle diameter may be calculated from an FIB-SIM image of a portion of the metal films 63 or may be calculated from an FIB-SIM image within a range of about 5 μm in the direction along the one surface 43, for example.

The electroless plating can reduce the unevenness in film thickness of the metal films 63 because of the precipitation timing described above. In contrast, the electrolytic plating makes the film thickness of the metal films 63 on the resin 45 smaller than the film thickness of the metal films 63 on the metal magnetic powder 46. When the thinnest portions of the films are made uniform in thickness, the metal films 63 with reduced unevenness can have the thickest portions of the films made thinner as compared to films with severe unevenness and can consequently have a smaller film thickness.

Preferably, a portion of the film thickness of the metal films 63 on the metal magnetic powder 46 is equal to or less than the film thickness of the metal films 63 on the resin 45. As a result, the unevenness in the coil component 1 can be reduced. Particularly, since the metal films 63 constitute the external terminals 61, 62, the mounting stability and the reliability are improved.

Preferably, the metal magnetic powder 46 is made of metal or alloy containing Fe, and the metal films 63 are made of metal or alloy containing Cu. In this case, by grinding the one surface 43 of the magnetic resin layer 40, the metal magnetic powder 46 containing Fe baser than Cu can be exposed on the one surface 43. Immersion of the one surface 43 into an electroless plating solution containing Cu causes precipitation of Cu displacing Fe, and the plating subsequently grows due to the effect of a reducing agent contained in the electroless plating solution, so that the metal films 63 containing Cu can be formed. As a result, the metal films 63 can be formed by the electroless plating without using a catalyst. Since the metal films 63 are made of metal or alloy containing Cu, the conductivity can be improved.

Preferably, the film thickness of the metal films 63 on the metal magnetic powder 46 is 60% or more and 160% or less of the film thickness of the metal films 63 on the resin 45. As a result, the film thickness of the metal films 63 becomes uniform. Therefore, the unevenness in the coil component can be reduced. Particularly, when the metal films 63 constitute the external terminals 61, 62, the mounting stability and the reliability are improved. The film thickness may be calculated from the image analysis, or may directly be measured, in the FIB-SIM image of the metal films 63, for example. Although the relation of the ratio of the film thickness is preferably established in all of the metal films 63, the effect is produced even when the relation is established in a portion of the metal films 63. Therefore, the film thickness may be calculated from an FIB-SIM image of a portion of the metal films 63 or may be calculated from an FIB-SIM image within a range of about 5 μm in the direction along the one surface 43, for example, or the film thicknesses measured at several positions (e.g., five positions) each on the resin 45 and the metal magnetic powder 46 may be compared. In comparison of the film thicknesses, preferably, the comparison is made between the average values of the respective film thicknesses on the resin 45 and on the metal magnetic powder 46.

Pd may exist in the interface between the metal magnetic powder 46 and the metal films 63 and, therefore, the metal films 63 may be formed by the electroless plating by using Pd as a catalyst. With this method, even when the metal films 63 are baser than the metal magnetic powder 46, for example, when the metal magnetic powder 46 is made of metal or alloy containing Cu and the metal films 63 are made of metal or alloy containing Ni, a displacement Pd catalyst treatment can be performed to form the metal films 63 by using the electroless plating. Therefore, in this case, a degree of freedom is improved in terms of material selection for the metal magnetic powder 46 and the metal films 63.

Figure 6:
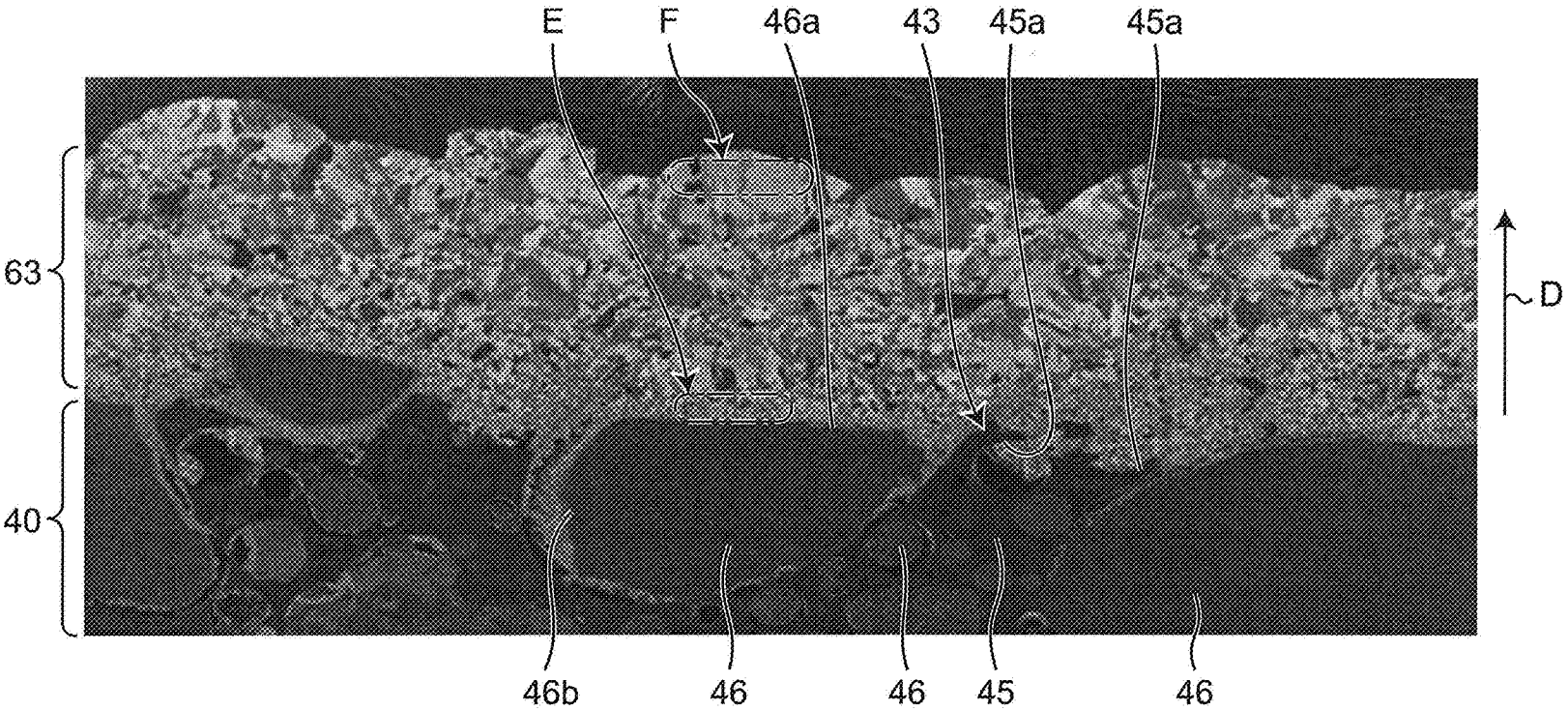
FIG. 6 is a cross-sectional image of a first example of the coil component.

FIG. 6 shows a cross-sectional image of an example of the coil component. FIG. 6 shows an FIB-SIM image when the metal film 63 is formed on the magnetic resin layer 40 by using the electroless plating. As shown in FIG. 6, when the film is formed by using the electroless plating, it can be seen that a portion of the metal film 63 goes around along the outer surface of the metal magnetic powder 46 to the inner side of the magnetic resin layer 40. Specifically, as indicated by a light-colored portion extending along the outer surface of the metal magnetic powder 46 of FIG. 6, the metal film 63 has penetrated along the outer surface of the metal magnetic powder 46 into a gap between the resin 45 and the metal magnetic powder 46. In particular, the metal film 63 has precipitated not only on an exposed surface 46*a* of the metal magnetic powder 46 exposed from the resin 45 but also on a contained surface 46*b* of the metal magnetic powder 46 contained in the resin 45. Therefore, by forming the metal film 63 by using the electroless plating, a portion of the metal film 63 goes around along the outer surface of the metal magnetic powder 46 to the inner side of the magnetic resin layer 40 and the anchor effect is improved as described above.

As shown in FIG. 6, a crystal particle diameter of the metal film 63 formed by plating is made larger from the side contacting with the magnetic resin layer 40 toward the opposite side thereof (in the direction of an arrow D). In particular, it can be seen that the crystal particle diameter of the metal film 63 away from the magnetic resin layer 40 (a portion F of FIG. 6) is larger than the crystal particle diameter of the metal film 63 contacting with the magnetic resin layer 40 (a portion E of FIG. 6). In this way, the metal film 63 formed by using plating becomes larger in a region of later precipitation than a region of earlier precipitation.

The present disclosure is not limited to the embodiment described above and may vary in design without departing from the spirit of the present disclosure.

Although two layers of coil conductors are disposed as the coil component in the embodiment, one layer or three or more layers of the coil conductors may be disposed.

Although one coil conductor is disposed for each layer for the coil component in the embodiment, a plurality of coil conductors may be disposed for each layer.

Although the coil conductors of the coil component are formed into a plane spiral shape in the embodiment, the coil conductors may be formed into a cylindrical spiral shape.

Although the coil substrate is formed on one of both surfaces of the base in the embodiment, the coil substrate may be formed on each of both surfaces of the base. Alternatively, pluralities of the first and second coil conductors 21, 22 and the insulating resin layers 35 may be formed in parallel on one surface of the base and may be separated into individual pieces at the time of dicing so that a multiplicity of the coil substrates can be formed at the same time. As a result, higher productivity can be achieved.

Although the coil component is used for the thickness detection apparatus in the embodiment, the coil component may be used for any apparatus detecting a distance to a detected conductor, or may be used for an apparatus other than such an apparatus. The manufacturing method of the coil component is not limited to the embodiment.

The invention claimed is:

1. A coil component having a first surface and a second surface facing each other, comprising:

a coil conductor formed into a spiral shape;

an insulating resin layer covering the coil conductor;

a magnetic resin layer disposed on the first surface side of the insulating resin layer without being disposed on the second surface side of the insulating resin layer such that a surface of the insulating resin layer on the first surface side is in contact with the magnetic resin layer, and a surface of the insulating resin layer on the second surface side is exposed to an exterior of the coil component; and an external terminal disposed at least on one surface on the first surface side of the magnetic resin layer and electrically connected to the coil conductor, wherein the magnetic resin layer is made of a composite material of a resin and a metal magnetic powder, and the external terminal includes a metal film contacting the resin and the metal magnetic powder of the magnetic resin layer.

2. The coil component according to claim 1, wherein the coil component has an internal electrode that is embedded in the magnetic resin layer with an end surface exposed from the one surface of the magnetic resin layer and that is electrically connected to the coil conductor, the metal film of the external terminal is in contact with the end surface of the internal electrode, and the metal film has an area on the end surface side larger than the area of the end surface.

3. The coil component according to claim 1, wherein the external terminal has the metal film and a coating film covering the first surface side of the metal film.

4. The coil component according to claim 1, wherein the metal film of each of a plurality of external terminals is disposed on the one surface of the magnetic resin layer, and a resin film is disposed on a portion without the metal film on the one surface of the magnetic resin layer.

5. The coil component according to claim 4, wherein the external terminal is protruded further than the resin film to the side opposite to the one surface.

6. The coil component according to claim 4, wherein the resin film contains a filler made of an insulating material.

7. The coil component according to claim 4, wherein the resin film does not contain a filler.

8. The coil component according to claim 1, wherein the thickness of the metal film is equal to or less than ⅕ of the thickness of the coil conductor.

9. The coil component according to claim 1, wherein the thickness of the metal film is 1 μm or more and 10 μm or less.

10. The coil component according to claim 1, wherein the material of the metal film and the material of the internal electrode are the same kind of metal.

11. The coil component according to claim 1, wherein the magnetic resin layer has a recess in a portion of the one surface, and the metal film is filled into the recess.

12. The coil component according to claim 1, wherein the metal film goes around along an outer surface of the metal magnetic powder to an inner side of the magnetic resin layer.

* * * * *